US005431265A

United States Patent [19]

Yoo

[11] Patent Number: 5,431,265

[45] Date of Patent: * Jul. 11, 1995

[54] SPORTS ACCESSORY BAG

[76] Inventor: Eddie B. Yoo, 2908 Long Lake Rd., Troy, Mich. 48098

[ * ] Notice: The portion of the term of this patent subsequent to Jul. 20, 2010 has been disclaimed.

[21] Appl. No.: 89,816

[22] Filed: Jul. 12, 1993

Related U.S. Application Data

[63] Continuation-in-part of Ser. No. 855,541, Mar. 20, 1992, Pat. No. 5,228,547.

[51] Int. Cl.[6] ..... A45C 7/00

[52] U.S. Cl. ..... 190/103; 190/109; 190/111; 206/315.1

[58] Field of Search ..... 190/103, 104, 109, 111, 190/115, 116; 206/315.1; 383/2, 103

[56] References Cited

U.S. PATENT DOCUMENTS

| | | |
|---|---|---|
| D. 154,373 | 6/1949 | Feigl . |
| D. 154,755 | 8/1949 | Feigl . |
| D. 155,177 | 9/1949 | Nathan . |
| D. 158,378 | 5/1950 | Handlen . |
| D. 193,967 | 10/1962 | Schaefer . |
| D. 259,677 | 6/1981 | Rosenow . |
| D. 262,072 | 12/1981 | Pfeiffer . |
| D. 268,713 | 4/1983 | Pelavin et al. . |
| D. 278,190 | 4/1985 | Ganz . |
| D. 281,741 | 12/1985 | Katz et al. . |
| D. 284,332 | 6/1986 | Lowe et al. . |
| D. 286,229 | 10/1986 | Knoepke et al. . |
| 2,025,101 | 12/1935 | Halpin . |
| 2,577,670 | 12/1951 | Adams . |
| 2,691,401 | 10/1954 | Kontoff et al. . |
| 3,122,225 | 2/1964 | Ward . |
| 3,292,747 | 12/1966 | Dawson . |
| 3,327,924 | 6/1967 | Brutting . |
| 3,830,348 | 8/1974 | Ohyama . |
| 3,989,080 | 11/1976 | Koszegi . |
| 4,094,351 | 6/1978 | Catenaccio . |
| 4,177,909 | 12/1979 | Haskell . |
| 4,236,615 | 12/1980 | Ginat . |
| 4,334,601 | 6/1982 | Davis . |
| 4,361,215 | 11/1982 | Sawai . |
| 4,513,866 | 4/1985 | Thomas . |
| 4,733,759 | 3/1988 | Shih-Chen . |
| 4,756,394 | 7/1988 | Cohen . |
| 4,773,515 | 9/1988 | Kotkins, Jr. . |
| 4,805,749 | 2/1989 | Gerch . |
| 4,830,154 | 5/1989 | Gerch et al. . |
| 4,923,060 | 5/1990 | Breslau . |
| 5,228,547 | 7/1993 | Yoo ..... 190/103 |

FOREIGN PATENT DOCUMENTS

| | | |
|---|---|---|
| 199326 | 8/1958 | Austria . |
| 643888 | 7/1962 | Canada . |
| 987540 | 4/1951 | France . |
| 2902138 | 7/1980 | Germany . |
| 378477 | 7/1964 | Switzerland . |

*Primary Examiner*—Gary E. Elkins
*Attorney, Agent, or Firm*—Spencer, Frank & Schneider

[57] ABSTRACT

A multi-compartment bag has a ventilated compartment for storage of athletic shoes, an expansible compartment for storage of items of clothing, and a reinforced racket compartment for storage of a racket. The ventilated compartment includes an adjustable dividing structure for forming a plurality of sub-compartments including at least one adjustable shoe sub-compartment and at least one accessory sub-compartment, air passages for providing a passageway for ventilation air to enter and exit the ventilated compartment from outside the bag, and fasteners for opening and closing the ventilated compartment. The expansible compartment includes an expansible panel having a slide fastener for expanding and collapsing the expansible compartment by opening and closing of the slide fastener.

20 Claims, 6 Drawing Sheets

SPORTS ACCESSORY BAG

CROSS-REFERENCE TO RELATED APPLICATIONS

This is a continuation-in-part of, and claims the benefits of priority of, application Ser. No. 07/855,541, filed Mar. 20th, 1992, now U.S. Pat. No. 5,228,547 issued Jul. 20th, 1993, entitled "Golf Accessory Bag," the subject matter of which is hereby incorporated by reference.

BACKGROUND 0F THE INVENTION

1. Field Of The Invention

The present invention relates generally to sports accessory bags. More specifically, the invention relates to an improved accessory bag having multiple compartments for separate storage of athletic shoes and accessories, including at least one expandable compartment, and a reinforced compartment for carrying a racket.

2. Background Information

Prior to the present invention there were known numerous varieties of accessory bags, sports shoe bags, racket carrying cases, and the like. However, these generally were not adequate in meeting the needs of the modern amateur or professional athlete for a single bag in which athletic shoes, clothing, and a variety of accessories, including a racket, could be conveniently carried.

One of the problems with the known bags was that they did not have separate compartments for items of clothing. Therefore, either another bag for the clothing needed to be used or else the clothing had to be placed in the same bag compartment as the shoes, often resulting in an undesirable contamination of the clothing with dirt or odor from the shoes. The racket carrying cases known provided practically no room for carrying clothes or other items.

Another problem is that, given the varying weather conditions that may be encountered on a tennis court, for example, an athlete might find it necessary to carry a jacket or sweater, in addition to a change of socks, and other items of clothing, one day, and have no need of them on another. Thus, the amount of storage capacity needed for clothes varies considerably and may disadvantageously require the athlete to have an assortment of bags available, with associated trouble and expense.

Therefore, there existed a need for a athletic shoe and accessory bag having separate compartments for shoes and items of clothing, having a clothes compartment with the ability to expand and collapse depending on the instantaneous needs of the user, having a reinforced compartment for securely carrying a racket, and having other compartments for carrying a variety of accessories.

SUMMARY OF THE INVENTION

The present invention overcomes the above-mentioned problems and fills the above-mentioned needs by providing a multi-compartment bag having a ventilated compartment for storage of athletic shoes, an expansible compartment for storage of items of clothing, and a reinforced racket compartment for storage of a racket. The ventilated compartment includes adjustable dividing means for forming a plurality of sub-compartments, the sub-compartments including at least one shoe sub-compartment and at least one shoe accessory sub-compartment, air passage means for providing a passageway for ventilation air to enter and exit the ventilated compartment from outside the bag, and fastening means, e.g., zippers, for opening and closing the ventilated compartment. The expansible compartment includes an expansible panel having a slide fastener for expanding and collapsing the expansible compartment by opening and closing thereof, respectively.

The bag according to the invention may also be advantageously provided with a clear plastic pocket disposed on the bottom for holding an identification card.

The bag according to the invention may also be advantageously provided with a small pocket having an opening disposed on a first exterior side surface of the bag for holding a shoe horn, and a ball/birdie compartment disposed on a second exterior side surface of the bag for holding at least one of a badminton birdie, a tennis ball, a squash ball or a racket ball.

In the bag according to the invention, the racket compartment includes a vinyl/plastic cover for protection of both sides of a racket and securing means for securing the handle of the racket when the racket is carried in the racket compartment.

The ventilated compartment may be provided with at least two ventilation holes on each side of the bag to provide adequate ventilation to the compartment. The ventilated compartment, including the dividing means for forming the sub-compartments for separating items stored therein, may be advantageously reinforced with molded plastic to provide a rigid structure. The molded plastic is advantageously fitted into stitched borders of the ventilated compartment.

The bag according to the invention may also be advantageously provided with a lockable front pocket for carrying small or thin items such as airline tickets, schedules, receipts, country club brochures, magazines, maps, address books, pocket calculators, Rolex watches, beepers, pagers, and the like.

The bag according to the invention may also be advantageously provided with a single-arched handle attached to a first exterior surface of the bag, the handle having a wrap-around hand piece sewn into a middle portion and provided with a velcro-type closure so that the wrap-around piece may be wrapped around the handle and secured to aid in hand-carrying the bag, and an adjustable shoulder strap removably attached to the first exterior surface of the bag.

The at least one shoe sub-compartment may include first and second shoe compartments each for holding at least one shoe. The plurality of sub-compartments may include a sub-compartment for removably accommodating a shaving/cosmetic kit disposed between the first and second shoe compartments.

Locking strap means for securing and locking at least the ventilated compartment, the expansible compartment and the racket compartment, and including a slot through which a racket handle can extend when a racket is disposed in the racket compartment is also advantageously provided.

Other advantageous features will become apparent from the following description of a preferred embodiment taken with the accompanying drawings.

DETAILED DESCRIPTION OF THE PREFERRED EMBODIMENT

Figure 1:
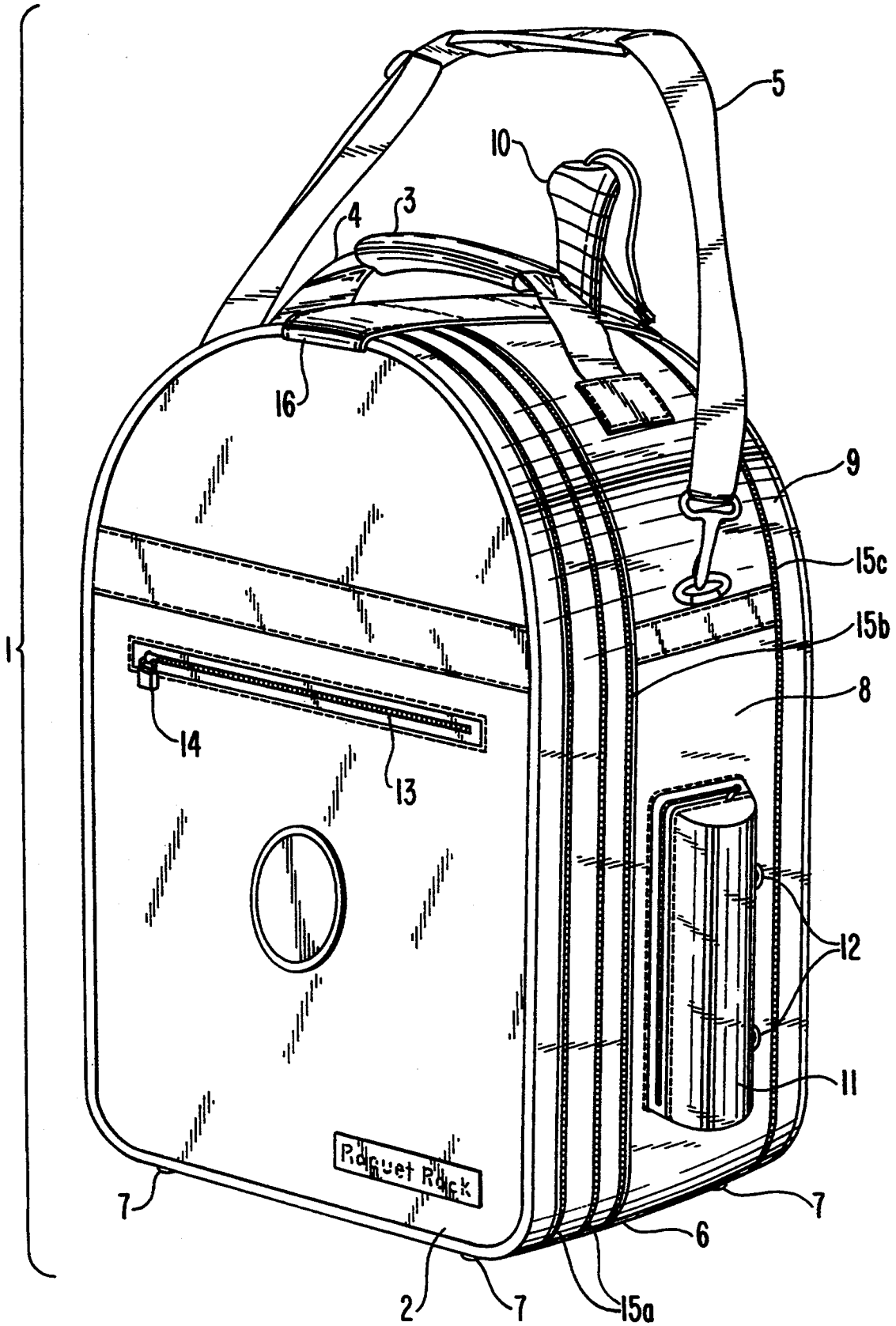
FIG. 1 is an exterior perspective view of the front, top and one side of a closed upright bag according to an embodiment of the invention.

An embodiment of the accessory bag according to the invention is shown in FIG. 1. The reference number 1 represent the accessory bag as a whole which is preferably constructed of several leather or vinyl material components sewn together and provided with zippers. The bag 1 is shown in an upright orientation as it would be when carried. The bag 1 has a front body portion 2 which is hinged to the bag 1 at the bottom portion 6. When the bag 1 is being carried, wrap-around hand piece 3 removably attached to carrying handle 4 provides a comfortable fit to the human hand. An adjustable shoulder strap 5 is also provided for shoulder carrying of the bag 1. The shoulder strap 5 is conveniently made to be removable for storage when not in use.

Portions of the bag 1 may be rigidly reinforced with, for example, molded plastic. The bottom surface 6 of bag 1 is advantageously provided with a flat rigid reinforcement piece of molded plastic so that the bag 1 rests stably when set down on a flat surface in the upright position. Small metal or plastic feet 7 may be provided on the bottom 6 as well.

Shoulder strap 5 and handle 4 are attached to middle side portion 8. A rear side portion 9 forms part of a racket compartment described later in more detail for holding a racket 10. Also attached to middle side portion 8 is a birdie/ball compartment 11 for holding badminton birdies, tennis balls, racket balls, and the like. Middle side portion 8 forms a part of a ventilated compartment described later in more detail and is provided with ventilation holes 12 on either side of the bag 1.

Front body portion 2 has a lockable front pocket or compartment opened and closed by zipper 13 and lock 14. This provides a convenient place to store small items, especially small flat or thin items such as magazines, schedules, air line tickets, receipts, maps, and the like, easily accessible to the user without opening the rest of the bag 1. Between front body portion 2 and middle side portion 8, an expandable compartment is formed which will be described in more detail later, and zipper 15a allows front body portion 2 to be opened to provide access to this expandable compartment.

Also shown in FIG. 1 is security strap 16 which extends from the front of the bag to the rear where it is lockable. Security strap 16 has a slot or opening for allowing the handle of a racket 10 to extend therethrough when in the locked condition.

Figure 2:
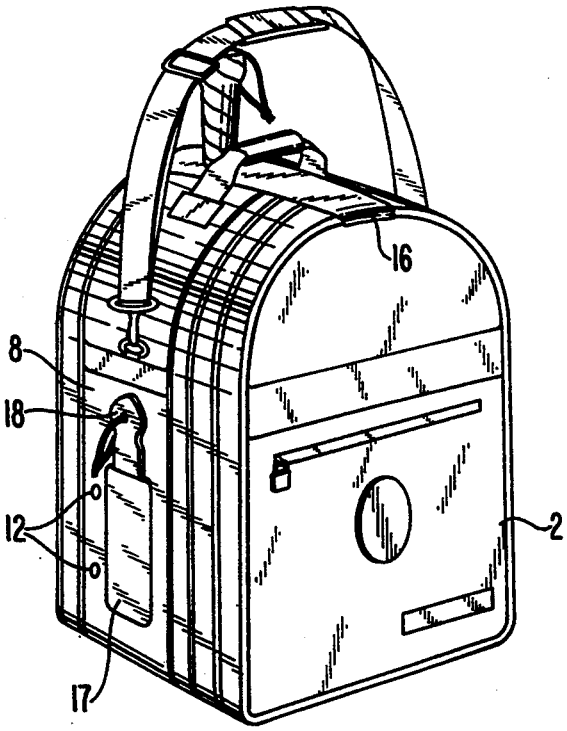
FIG. 2 is an exterior perspective view of the front, top and the other side of the closed upright bag according to an embodiment of the invention shown in FIG. 1.

FIG. 2 shows the front, top and the other side of the embodiment shown in FIG. 1. A small side pocket 17 for holding a shoe horn 18, or similar item, is provided on middle side portion 8. Further ventilation holes 12 are visible on this side of the bag 1 as well.

Figure 3:
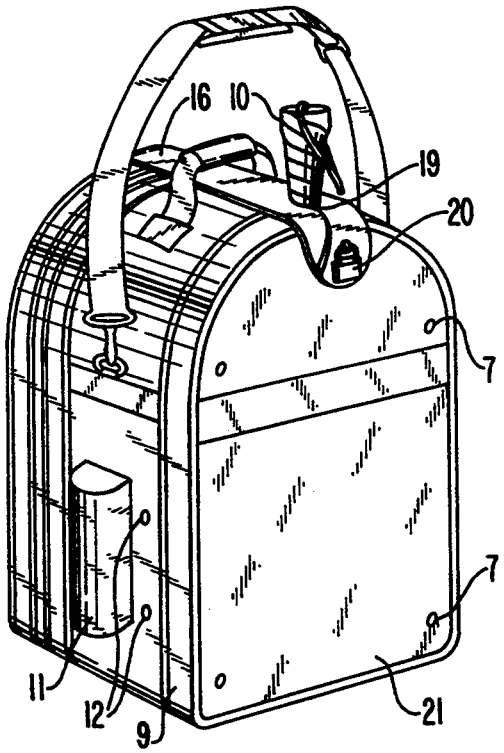
FIG. 3 is an exterior perspective view of the rear, top and the first side of the closed upright bag according to an embodiment of the invention shown in FIGS. 1 and 2.

FIG. 3 shows the rear of the bag 1 of FIGS. 1 and 2. From this perspective, slot or opening 19 in security strap 16 through which a handle of racket 10 extends is visible, along with lock 20. Rear portion 21 together with rear side portion 9 forms the exterior of a racket compartment for holding racket 10. The rear portion 21 is reinforced to provide protection for the racket 10. Small metal or plastic feet 7 may be provided on the surface of rear portion 21 as shown to support the bag 1 when oriented horizontally with the rear portion 21 down.

Figure 4:
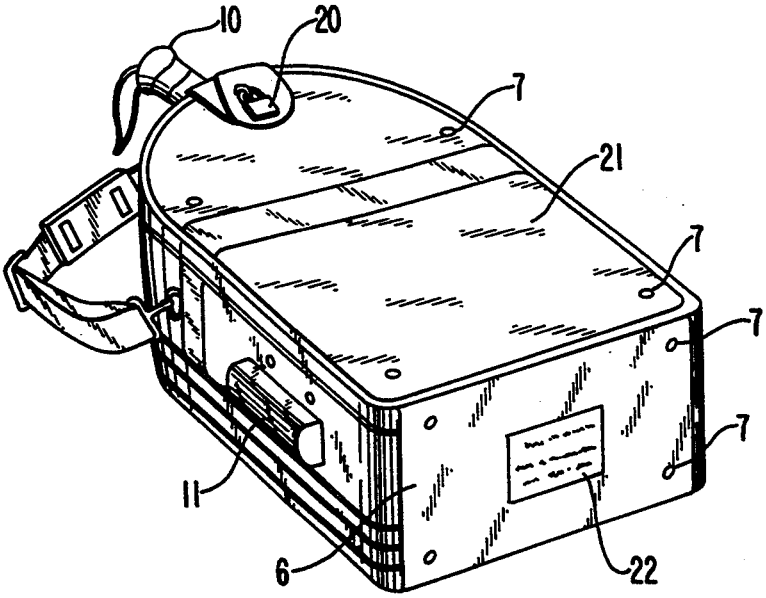
FIG. 4 is an exterior perspective view of the rear, bottom and the first side of the closed bag according to an embodiment of the invention shown in FIGS. 1, 2, and 3 disposed in a horizontal prone position.

FIG. 4 shows the bottom portion 6 of the bag 1, which is provided with a clear plastic pocket 22 for holding an identification card or the like.

Figure 5:
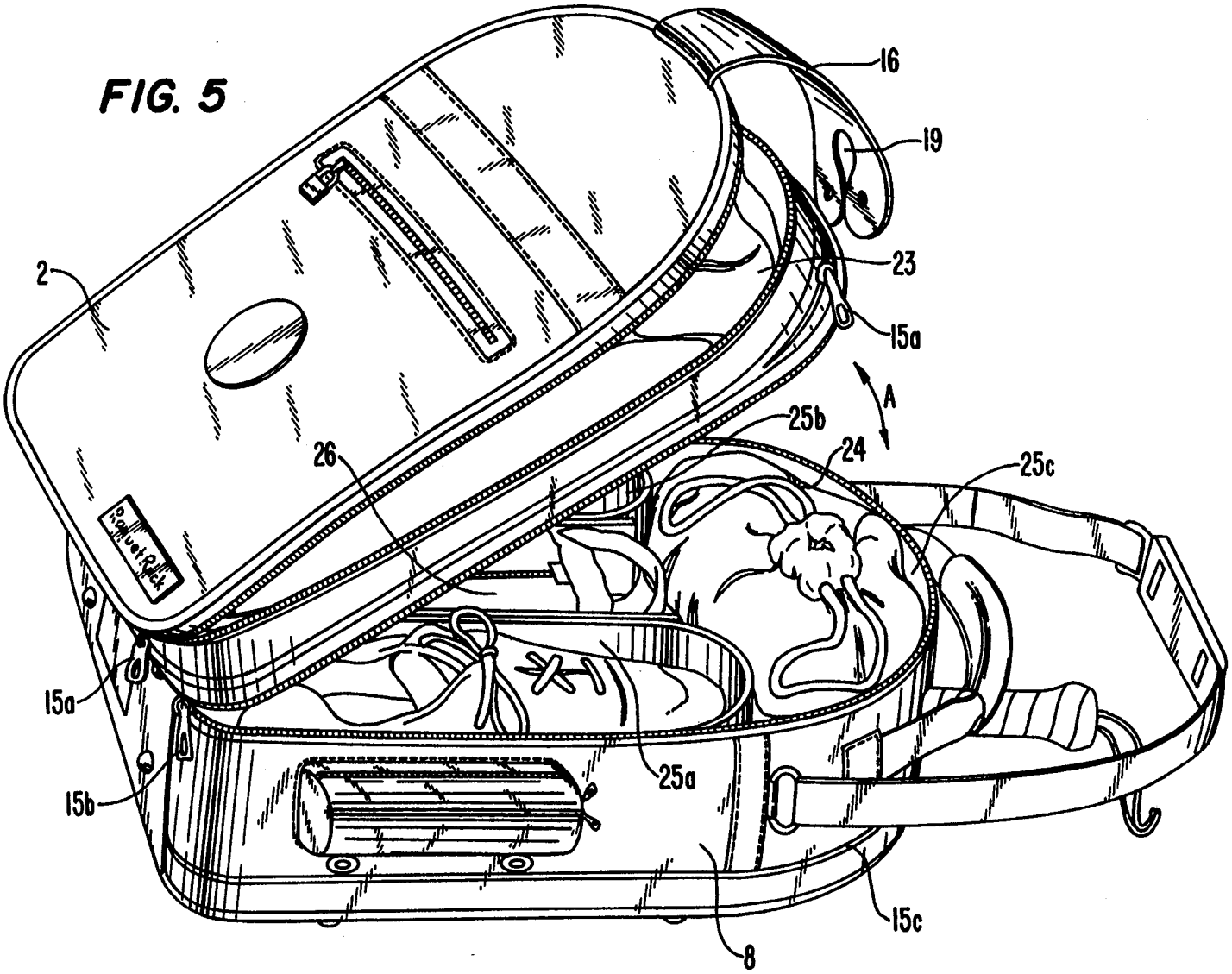
FIG. 5 is a perspective view of the bag according to FIGS. 1 to 4 in a partially open condition to show the inner compartments containing shoes and other items.

FIG. 5 shows the expandable compartment 23 and the ventilated compartment 24 of the bag 1 being opened in the direction of arrow A while the bag 1 is in a horizontal position. Zipper 15*a* operates to open and expand the expandable compartment 23. The expandable compartment is substantially as described in U.S. Pat. No. 5,228,547 and further description thereof is, therefore, not deemed necessary. Zipper 15*b* opens the ventilated compartment 24, and zipper 15*c* opens the racket compartment (shown closed). The expandable compartment 23 is advantageously used to store items of clothing such as shirts or blouses, long or short pants or skirts, socks, sweaters, gloves, swim-wear, towels, and the like, and the compartment surfaces are, therefore, preferably lined with fabric. Ventilated compartment 24 has sub-compartments 25*a* and 25*b* for the storage of shoes (one shoe is shown). Accessories are stored in another sub-compartment 25*c*, e.g., a shoe accessory pouch having a rope-tie for opening and closing the shoe accessory pouch, as shown. Shoe brushes, shoe polish, or the like may be conveniently stored in this area. Other items could be stored in an accessory pouch such as gloves, head bands, wrist bands, goggles, knee or elbow pads, athletic supporter and/or athletic bras, cosmetics, etc. Between the shoe sub-compartments 25*a* and 25*b*, another sub-compartment 25*d* is provided for storage of a shaving/cosmetic kit 26, for example.

Figures 6, 6A:
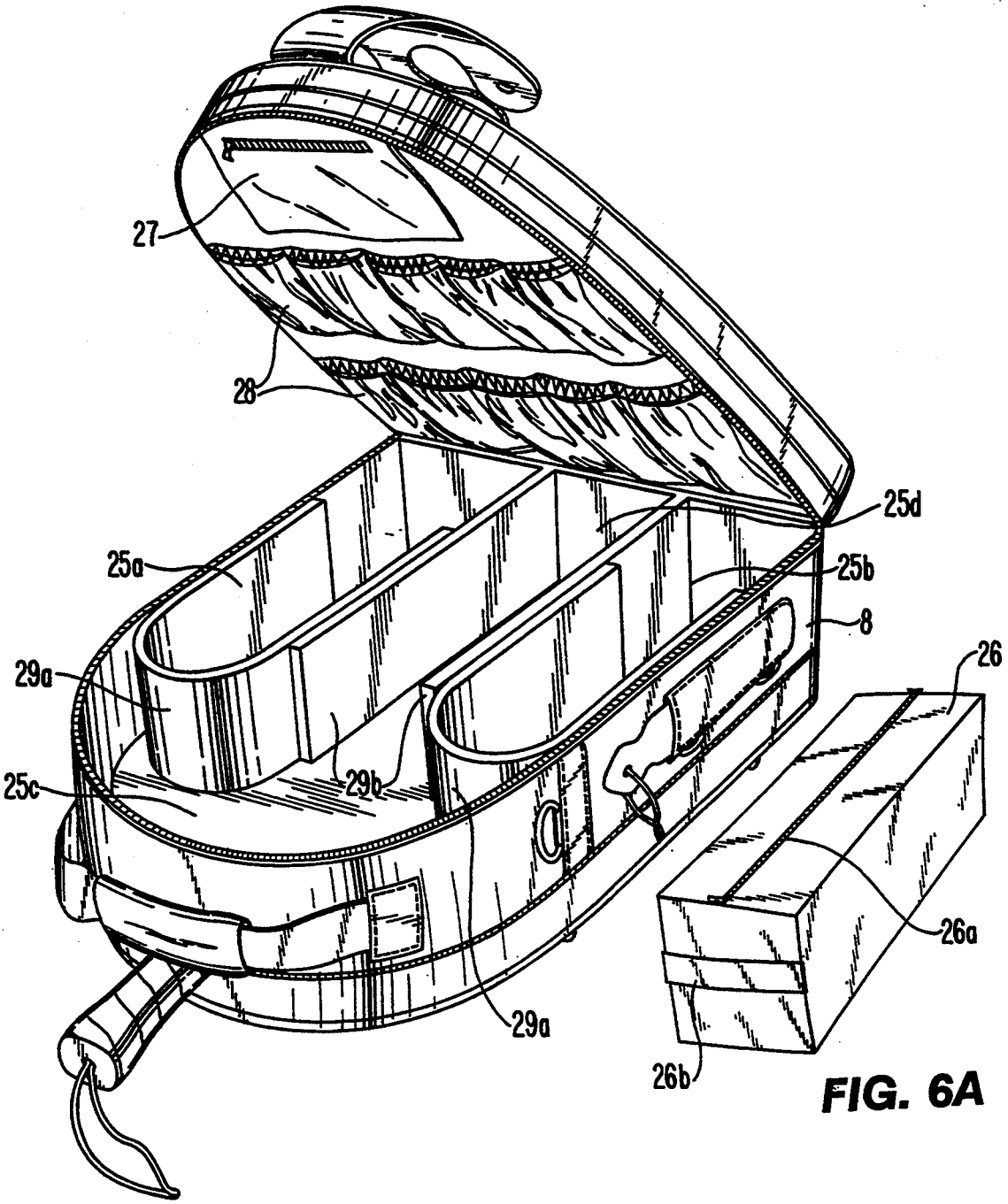
FIG. 6 is a perspective view of the bag according to FIGS. 1 to 5 shown in a partially opened condition with empty inner compartments.
FIG. 6*a* is a perspective view of a removable shaving-/cosmetic kit removed from the embodiment of FIGS. 1 to 6.

FIG. 6 shows more clearly the arrangement of the sub-compartments for shoes (25*a*, 25*b*), accessories (25*c*) and for a shaving/cosmetic kit 26 (sub-compartment 25*d*) in the ventilated compartment 24. Also visible in FIG. 6 are personal possession compartment 27 and a plurality of personal hygiene compartments 28. Watches, rings, bracelets, necklaces or other jewelry, a wallet, glasses, etc, may be stored in the personal possession compartment 27. The personal hygiene compartments 28 are designed to hold items such as hair spray, deodorant, powders, perfumes, shampoo, conditioner, etc. These compartments 28 may be formed, for example, as pockets of fabric with an elastic piece sewn in an opening edge to hold an item in the pocket opening.

As can be seen in FIG. 6, the shoe sub-compartments 25*a* and 25*b* are formed by molded pieces 29*a* and 29*b* forming a rough outline of shoes and provide protection to shoes from crushing. The form of the shoe sub-compartments 25*a* and 25*b* is adjustable by changing the relative position of respective pieces 29*a* with respect to pieces 29*b*, so that a variety of shoes and shoe sizes may be accommodated therein. A respective piece 29*a* may be adjustably attached to piece 29*b* by snap or velcro-type fasteners, for example.

The shoulder strap 5 has been removed from the bag 1 in the FIG. 6 illustration, and shaving/cosmetic kit 26 has been removed from the sub-compartment 25*d* between pieces 29*b*, as shown in FIG 6*a*. The block-shaped shaving/cosmetic kit 26 preferably has a double-headed slide-type closure 26*a* on a top surface and a carrying handle 26*b* on an end surface, as illustrated. The shaving/cosmetic kit 26 is shaped and dimensioned to fit snugly between pieces 29*b* in sub-compartment 25*d*. Fastening means could be provided to secure shaving/cosmetic kit 26 in the sub-compartment 25*d*, for example, on pieces 29*b*.

Figure 7:
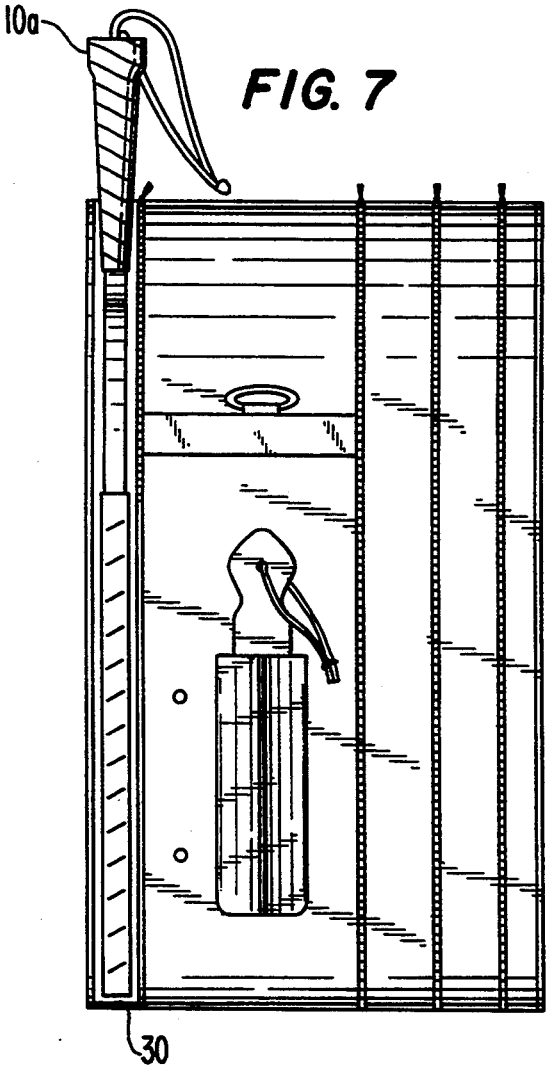
FIGS. 7 and 8 are respective side views of the embodiment of FIGS. 1 to 6 showing the racket compartment in cross-section with a different respective racket disposed therein.
Figure 8:
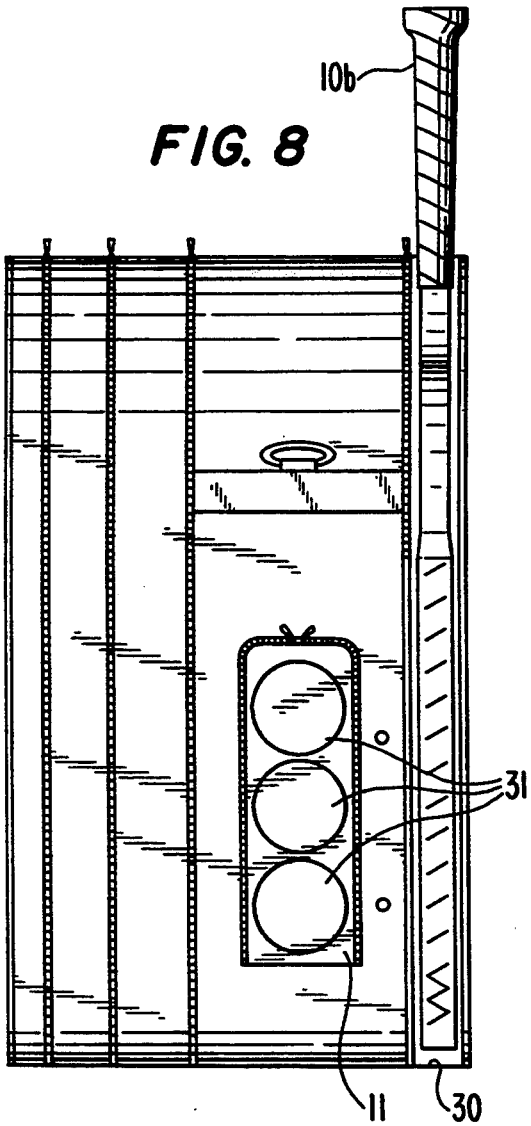

FIGS. 7 and 8 show respective side views of the bag 1 with the racket compartment 30 shown in cross-section. In FIG. 7 a squash racket 10*a* is disposed in the compartment 30, and in FIG. 8, a tennis racket 10*b* is shown in the compartment 30. Birdie/ball compartment 11 is shown containing three tennis balls 31 in FIG. 8.

Figure 10:
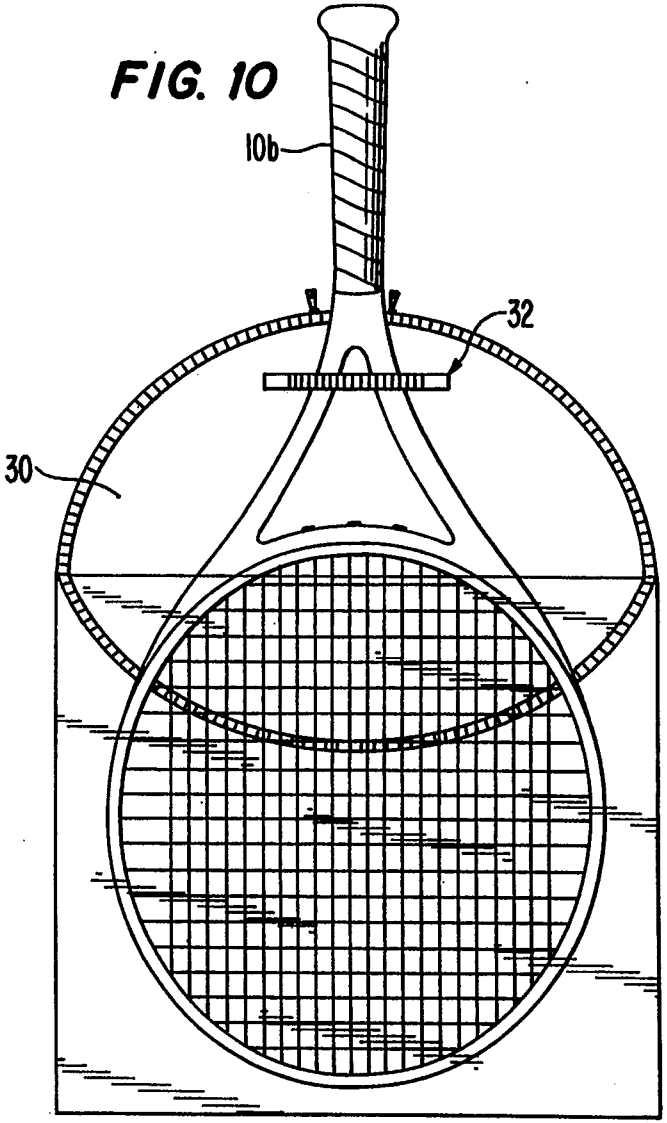
FIGS. 9 and 10 are respective rear views of the embodiment of FIGS. 7 and 8 showing the racket compartment with a different respective racket secured and disposed therein.
Figure 9:
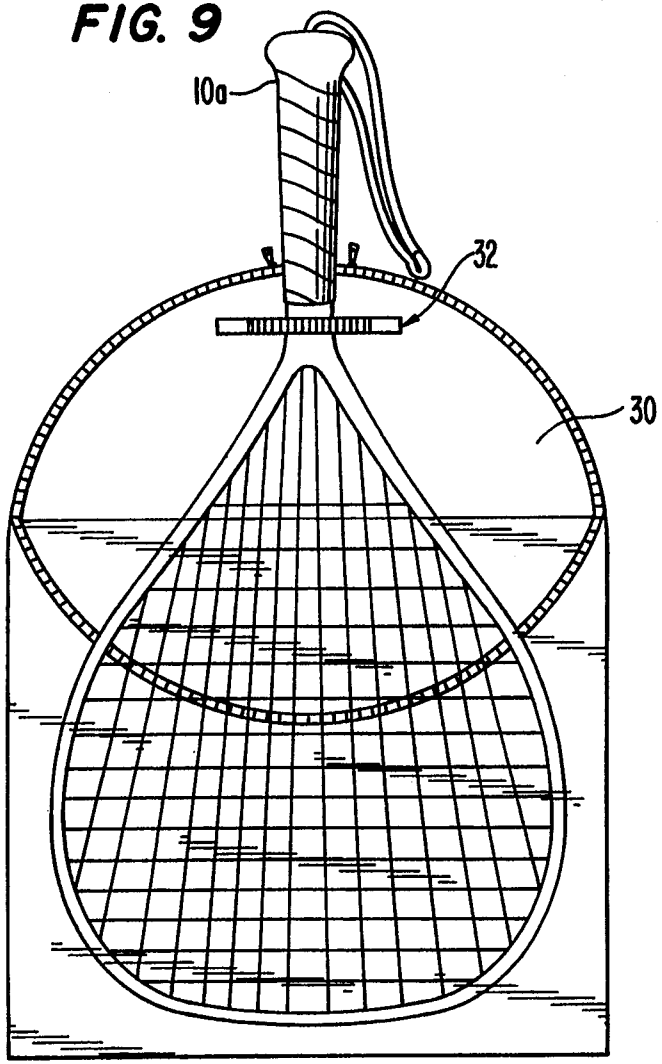

FIGS. 9 and 10 show a plan view of the racket compartment 30 opened with the respective rackets 10*a* and 10*b* disposed therein. Visible in these figures is the strap 32 for securing the racket handle. Strap 32 may have a snap, button or velcro-type fastener, for example, and/or may be made of a durable elastic material.

The racket compartment 30 is preferably formed of plastic, e.g., vinyl, on both front and rear sides to provide a reinforced cover protecting the face of a racket 10 when stored therein.

It will be understood that the above description of the present invention is susceptible to various modifications, changes and adaptations, and the same are intended to be comprehended within the meaning and range of equivalents of the appended claims.

I claim:

1. A multi-compartment bag having a ventilated compartment for storage of athletic shoes, an expansible compartment for storage of items of clothing, and a reinforced racket compartment for storage of a racket, wherein the ventilated compartment includes adjustable dividing means for forming a plurality of sub-compartments, the sub-compartments including at least one adjustable shoe sub-compartment and at least one accessory sub-compartment; air passage means for providing a passageway for ventilation air to enter and exit the ventilated compartment from outside the bag; and fastening means for opening and closing the ventilated compartment; and wherein the expansible compartment includes an expansible panel having a slide fastener for expanding and collapsing the expansible compartment by opening and closing thereof, respectively.

2. The multi-compartment bag according to claim 1, further comprising a clear plastic pocket disposed on an exterior bottom surface of the bag for holding an identification card.

3. The multi-compartment bag according to claim 1, further comprising a small pocket having an opening disposed on a first exterior side surface of the bag for holding a shoe horn, and a ball/birdie compartment disposed on a second exterior side surface of the bag for holding at least one of a badminton birdie, a tennis ball, a squash ball or a racket ball.

4. The multi-compartment bag according to claim 1, wherein said reinforced racket compartment comprises a plastic cover for protection of both sides of a racket and securing means for securing the handle of the racket when the racket is carried in said racket compartment.

5. The multi-compartment bag according to claim 1, wherein the bag further comprises reinforcing means of molded plastic fitted into stitched borders of bag wall members, and wherein the adjustable dividing means is composed of molded plastic.

6. The multi-compartment bag according to claim 1, further comprising locking strap means for securing and locking at least the ventilated compartment, the expansible compartment and the racket compartment, and including an opening through which a racket handle can extend when a racket is disposed in the racket compartment.

7. The multi-compartment bag according to claim 1, further comprising a lockable front pocket having an opening disposed on an exterior surface of the bag for carrying small items therein.

8. The multi-compartment bag according to claim 1, wherein the fastening means comprises zippers.

9. The multi-compartment bag according to claim 1, wherein the air passage means comprises at least two holes disposed on opposite sides of the bag.

10. The multi-compartment bag according to claim 1, further comprising carrying means for facilitating carrying of the bag, the carrying means including a single-arched handle attached to a first exterior surface of the bag, the handle having a wrap-around hand piece sewn into a middle portion and provided with a velcro-type closure so that the wrap-around piece may be wrapped around the handle and secured to aid in hand-carrying the bag, and an adjustable shoulder strap removably attached to the first exterior surface of the bag.

11. The multi-compartment bag according to claim 1, wherein the at least one shoe sub-compartment comprises first and second shoe compartments each for holding at least one shoe and wherein the plurality of sub-compartments further includes a sub-compartment for removably accommodating a shaving/cosmetic kit disposed between the first and second shoe compartments.

12. A sports accessory bag, having first, second, third, and fourth body portions, wherein:

a reinforced racket compartment is formed by and between the first and second body portions for securely holding a sports racket therein;

a ventilated compartment is formed by and between the second and third body portions, the second body portion being provided with divider means for forming at least one shoe sub-compartment for storing shoes and at least one accessory sub-compartment for storing accessories;

an expandable compartment is formed by and between the third and fourth body portions, for storing items of clothing, the third body portion being provided with fasteners for adjusting a width thereof thereby expanding the expandable compartment; and the second, third and fourth body portions are provided with fasteners along adjacent edges for opening and closing the ventilated and expandable compartments.

13. The sports accessory bag according to claim 12, further comprising a clear plastic pocket disposed on an exterior bottom surface of the second body portion of the bag for holding an identification card.

14. The sports accessory bag according to claim 13, further comprising a small pocket having an opening disposed on a first exterior side surface of the second body portion of the bag for holding a shoe horn, and a ball/birdie compartment disposed on a second exterior side surface of the second body portion of the bag for holding at least one of a badminton birdie, a tennis ball, a squash ball or a racket ball.

15. The sports accessory bag according to claim 14, wherein the third body portion includes, disposed on an inner surface thereof facing the second body portion in the ventilated compartment, a personal possession compartment and a plurality of personal hygiene compartments.

16. The sports accessory bag according to claim 15, wherein the ventilated compartment is provided with ventilation holes disposed in the second body portion on each side of the bag to provide ventilation of the compartment.

17. The sports accessory bag according to claim 16, wherein at least one of the second and third body portions forming the ventilated compartment is reinforced with molded plastic fitted into stitched borders of the body portions to provide a rigid structure.

18. The sports accessory bag according to claim 17, further comprising security strap means including a lock, the security strap means extending from said first body portion to said fourth body portion and including a slot through which a racket handle can extend when a racket is disposed in the racket compartment.

19. The sports accessory bag according to claim 17, wherein the ventilated compartment divider means, for forming the shoe and accessory sub-compartments therein, is composed of molded plastic.

20. The sports accessory bag according to claim 19, further comprising a lockable front pocket having an opening disposed on an exterior surface of the fourth body portion of the bag for carrying small items therein, and carrying means for facilitating carrying of the bag, the carrying means including a single-arched handle attached to the second body portion of the bag, the handle having a wrap-around hand piece sewn into a middle portion and provided with a velcro-type closure so that the wrap-around piece may be wrapped around the handle and secured to aid in hand-carrying the bag, and an adjustable shoulder strap removably attached to the second body portion of the bag.

* * * * *